US012553236B2

(12) United States Patent
Haddad

(10) Patent No.: US 12,553,236 B2
(45) Date of Patent: Feb. 17, 2026

(54) INSULATED HOLLOW CORE CONCRETE FORMING SYSTEM FOR WALLS AND SLABS

(71) Applicant: Sharif Haddad, London (CA)

(72) Inventor: Sharif Haddad, London (CA)

( * ) Notice: Subject to any disclaimer, the term of this patent is extended or adjusted under 35 U.S.C. 154(b) by 185 days.

(21) Appl. No.: 18/421,032

(22) Filed: Jan. 24, 2024

(65) Prior Publication Data

US 2025/0137253 A1 May 1, 2025

Related U.S. Application Data

(60) Provisional application No. 63/594,426, filed on Oct. 31, 2023.

(51) Int. Cl.

| | |
|---|---|
| ***E04B 2/86*** | (2006.01) |
| ***E04B 1/16*** | (2006.01) |
| ***E04B 1/76*** | (2006.01) |
| ***E04B 2/42*** | (2006.01) |
| ***E04B 2/54*** | (2006.01) |
| ***E04B 2/84*** | (2006.01) |
| ***E04C 2/20*** | (2006.01) |
| ***E04C 2/288*** | (2006.01) |

(52) U.S. Cl.

CPC ..... *E04B 2/8635* (2013.01); *E04B 2/42* (2013.01); *E04B 2/8647* (2013.01); *E04B 1/161* (2013.01); *E04B 1/7604* (2013.01); *E04B 2/54* (2013.01); *E04B 2/84* (2013.01); *E04B 2/8611* (2013.01); *E04B 2/8617* (2013.01); *E04B 2/8629* (2013.01); *E04B 2002/8676* (2013.01); *E04C 2/205* (2013.01); *E04C 2/288* (2013.01); *E04C 2/2885* (2013.01)

(58) Field of Classification Search

CPC . E04B 2/8652; E04B 5/19; E04B 1/24; E04B 1/7604; E04B 2/10; E04B 2/14; E04B 2/26; E04B 2/48; E04B 2/54; E04B 2/562; E04B 2/68; E04B 2/8617; E04B 2/8623; E04B 2/8629; E04B 2/8647; E04B 2/8635; E04C 2/288

See application file for complete search history.

(56) References Cited

U.S. PATENT DOCUMENTS 3,217,375 A * 11/1965 Kinnard ..... E04G 21/145 425/219
4,038,798 A * 8/1977 Sachs ..... B28B 19/0038 52/441
4,234,634 A * 11/1980 Longinotti ..... E04B 1/163 428/167

(Continued)

*Primary Examiner* — Omar F Hijaz

(57) ABSTRACT

Insulated hollow core concrete forming system provide a forming system which can integrate the advantages of the hollow core design into the Insulated concrete form (ICF) system. The Insulated hollow core form system includes one or more of a Modular formwork unit, composed and formed of insulative material, where the Modular formwork unit utilizes longitudinal void formers that crafts a forming cavity of a hollow core section in between two spaced parallel side panels. The forming cavity is disposed to receive concrete or other hardening materials to form an insulated hollow core wall or an insulated hollow core slab. The system also includes a furring strip assembly positioned between adjacent Modular formwork units to join them together.

6 Claims, 9 Drawing Sheets

(56) References Cited

U.S. PATENT DOCUMENTS

| | | | | |
|---|---|---|---|---|
| 5,038,541 | A * | 8/1991 | Gibbar, Jr. | E04B 2/8652 52/426 |
| 5,664,382 | A * | 9/1997 | Melnick | B26D 1/553 52/561 |
| 6,698,710 | B1 * | 3/2004 | VanderWerf | E04B 2/8652 52/294 |
| 6,955,014 | B2 * | 10/2005 | LeJeune | B28B 23/0025 52/223.6 |
| 7,784,235 | B2 * | 8/2010 | Cretti | E04B 5/19 52/332 |
| 9,097,009 | B2 * | 8/2015 | Niemann | E04B 1/80 |
| 2004/0088940 | A1 * | 5/2004 | LeJeune | B28B 23/0056 52/511 |
| 2013/0000222 | A1 * | 1/2013 | Robak | E04B 2/8652 52/700 |

* cited by examiner

INSULATED HOLLOW CORE CONCRETE FORMING SYSTEM FOR WALLS AND SLABS

REFERENCE TO RELATED APPLICATION

Provisional application No. U.S. 63/594,426 filed on Oct. 31, 2023.

BACKGROUND

The present disclosure relates generally to Insulated concrete form (ICF) systems and more particularly to a forming system for constructing insulated hollow core walls and slabs.

Insulated concrete form (ICF) systems, wherein the forms comprise part of the finished concrete structure, are known in the art. Insulated concrete form (ICF) systems, are forming systems that utilize pre-formed expanded polymeric foam panels that are fitted together to create a mold for concrete placement. These panels remain in place as part of the completed structure. This reduces labor costs and expenses through the use of lightweight and inexpensive materials that can be left in place after pouring concrete or other hardening materials into the form system, and can even serve as an adequate insulation layer for the building's envelope.

The problem with existing (ICF) systems is that they require more concrete due to the cavity formed which adds to the expense and upsurges the risk of form failure commonly known as bulging or blowout. Such failure can lead to the use of additional external bracing and supports that later must be removed, leading to increases in construction time and costs. Another drawback with (ICF) systems is that they are not strong enough for the attachment of heavy-weight external cladding such as bricks, fiber cement or similar heavy-weight materials, and do not have a structural system that can transfer the weight of the heavy exterior cladding to the concrete core without forming a thermal bridge. Some known (ICF) systems have plastic webs or furring strips for the attachment of the external cladding using screws. However, the furring strips or webs do not have enough screw pullout resistance to handle negative wind pressure in high winds conditions, and the screws also loosen over time, which leads to sagging of the external cladding and finishing materials.

Construction companies sometimes rely on hollow core slab structures to reduce the project completion time and cost by reducing the amount of concrete required for certain building projects. Hollow core slabs are manufactured with voids within the slabs that reduce the weight and the amount of concrete or other hardening materials used to manufacture them. These hollow core slabs are generally manufactured by extrusion offsite and afterward require transportation to the construction site. However, existing methods and transportation processes generate greater expenses.

Accordingly, it would be desirable to develop a forming system that can combine the benefits of the hollow core concrete design with the advantages of the Insulated concrete form system (ICF) in the construction industry. Resulting in a forming system that may require less concrete for walls and slabs and provide additional cost savings.

It would be further desirable to provide a forming system that can be stronger in holding attached finishing materials. In addition, a forming system that can be easier to erect which reduces the time and costs associated with training and installation. This may offer a solution for quicker, more affordable, and simpler construction onsite.

SUMMARY

It is therefore, an object of the present disclosure is, to develop a forming system in the construction industry that integrates the benefits of hollow core concrete design (e.g. reduced concrete quantity) with those of Insulated concrete form system (ICF) (e.g. stay-in-place concrete form), resulting in a construction method that produces slabs and walls with reduced quantity of concrete or hardening materials in a formwork structure.

Another object of the present disclosure is to provide a forming system with a higher safety holding attached finishing materials with greater pullout resistance.

Yet another object of the present disclosure is to provide a forming system that is easier to install.

Accordingly, in one general aspect, an Insulated hollow core concrete forming system directed towards constructing insulated hollow core walls and slabs comprises one or more, of a Modular formwork unit, composed and formed of insulative materials, where the Modular formwork unit incorporates a hollow core design technique by utilizing longitudinal void formers in between two spaced parallel side panels to define a forming cavity of a hollow core section; This forming cavity is disposed to receive concrete or other hardening materials to form a hollow core wall or a hollow core slab; The forming system also includes a furring strip assembly, which is composed of plastic material and is held between adjacent Modular formwork units to join them together; and where the furring strip assembly may have an I-shaped cross section defined by two retaining flanges and a connecting web spanning between the two retaining flanges.

Implementations may include one or more of the following features. The Insulated hollow core concrete forming system where the Modular formwork unit is formed to construct an insulated hollow core wall structure, and where the longitudinal void formers are truncated of upper and lower extents of the Modular formwork unit; This truncation defines a cavity that forms a hollow core wall and two edge beams located at top and bottom of the insulated hollow core wall structure. The Insulated hollow core concrete forming system where an interior surface of the two spaced parallel side panels is formed to have a corrugated pattern that may enable a reduction in thickness while preserving their rigidity. The Insulated hollow core concrete forming system where the Modular formwork unit is formed to construct an insulated hollow core slab structure, and the Modular formwork unit may have one or more cut openings to its upper side panel to facilitate the pouring of concrete or other hardening materials into the forming cavity; and where a metal furring assembly can be used between adjacent Modular formwork units to join them together, where this metal furring assembly may increase the distance between shoring support; and where the metal furring assembly may have an I-shaped cross-section defined by two retaining flanges and a connecting web spanning between the retaining flanges.

The Insulated hollow core concrete forming system further includes a metal casing C-channel having a C-section profile, where one of the retaining flanges of a furring strip assembly can slide into the metal casing C-channel. This metal casing C-channel reinforces the retaining flange and may provide a higher safety holding attached heavy finishing materials with greater pullout resistance. Also, the metal casing C-channel may facilitate connectivity between furring strip assemblies. The Insulated hollow core concrete forming system yet further includes another option which is a metal casing T-channel having a T-section profile, where one of the retaining flanges of a furring strip assembly can slide into the metal casing T-channel. This metal casing T-channel can reinforce the retaining flange and resist deflection.

Various other features, aspects and advantages of the present disclosure will become better understood regarding the following description, appended claims, and accompanying drawings.

BRIEF DESCRIPTION OF THE DRAWINGS

The drawing figures are not drawn to scale but instead are drawn to provide a better understanding of the present disclosure aspects and some implementations, and are not intended to be limiting in scope but to provide exemplary illustrations.

In the drawings.

DETAILED DESCRIPTION

Figure 1:
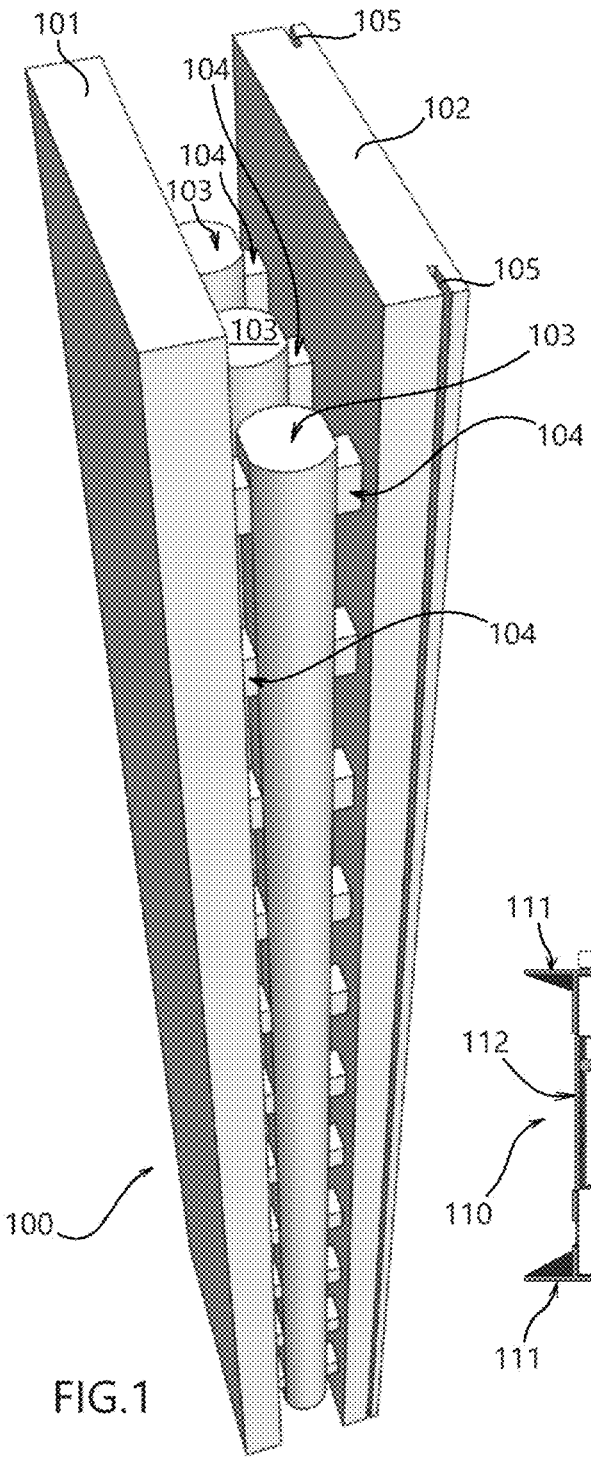
FIG. 1 is a perspective view of a Modular formwork unit formed to construct an insulated hollow core wall structure, according to the present disclosure.

A better understanding of different embodiments of the disclosure may be had from the following description read in conjunction with the accompanying drawings in which like reference characters refer to like elements. It is to be also understood that embodiments and some implementations illustrated in the attached drawings and described in the following specification, is an exemplary of the present disclosure.

An Insulated hollow core concrete forming system is disclosed herein. This forming system provides a construction method which enables the creation of a stay-in-place insulated hollow core structure and can serve as a universal concept to construct both interior and exterior insulated hollow core walls, as well as floor and roof insulated hollow core slabs.

A hollow core concrete design utilizes void formers within concrete slabs or walls to reduce overall weight while maintaining structural integrity. By incorporating hollow cores in a precise manner, the system ensures maximum efficiency in terms of material usage.

The Insulated hollow core concrete forming system disclosed herein combines the Insulated concrete form (ICF) system with the hollow core concrete design to further reduce the quantity of concrete or hardening materials required for construction. The reduction in concrete or hardening materials quantity leads to a decrease in the overall weight of the constructed slabs and walls, and a decrease in form failure, commonly referred to as bulging or blowout. This forming system results in material and cost savings, as well as facilitating ease of construction.

The Insulated hollow core concrete forming system includes one or more of a Modular formwork unit. This Modular formwork unit is composed and formed using rigid and lightweight insulative materials, such as expanded polystyrene foam (EPS) or extruded polystyrene foam (XPS). The Modular formwork unit remains in place as part of the completed structure and serves as an adequate insulation layer for the building's envelope. They provide improved acoustic performance and control heat loss between rooms and floors. Additionally, they can be easily modified on-site through hand-saw cutting to accommodate plumbing, HVAC systems, or structural requirements, such as having an embedded column. This flexibility allows more variety of applications such as having different architectural designs for the Modular formwork unit exterior surface.

The pressure exerted by wet concrete poured in the forming cavity of a Modular formwork unit of the present disclosure forming system is distributed across the interconnected sides of this Modular formwork unit, rather than solely borne by the furring strip assembly. This distribution of pressure helps to reduce the risk of form failure and blowouts even further to the risk reduction promoted by reducing concrete quantity. Moreover, this forming system doesn't require extra furring strip assemblies at shorter intervals to withstand increased pressure in a wider wall formwork. As a result, the cost and time associated with setting up additional materials for formwork erection, which is an existing challenge in vertical ICF systems, are reduced.

The forming system also includes a furring strip assembly that is used as a repetitive framing component that joins the Modular formwork units together. The furring strip assembly can generally be composed of a rigid polymer material, such as high-density polyethylene (HDPE), polyvinyl chloride (PVC), acrylonitrile butadiene styrene (ABS), or similar materials. The furring strip assembly can be of any sectional profile and two examples of which are in the present disclosure.

Figure 3:
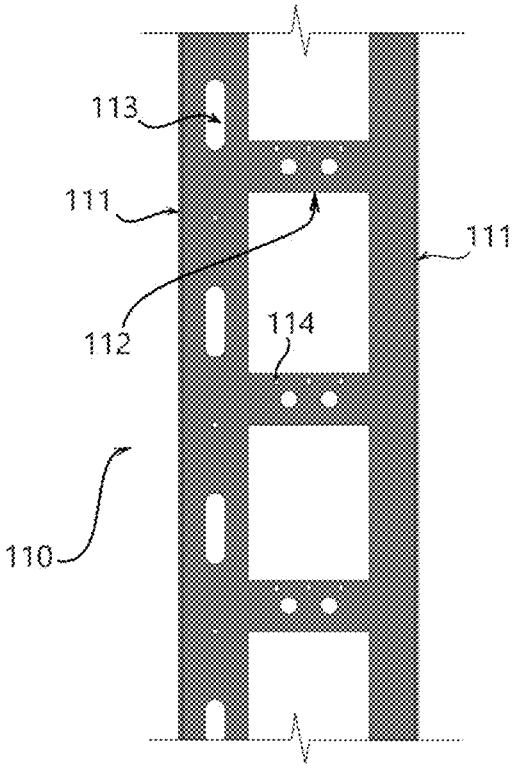
FIG. 3 is a side elevation view of a cut piece of the furring strip assembly shown in FIG. 2.
Figure 2:
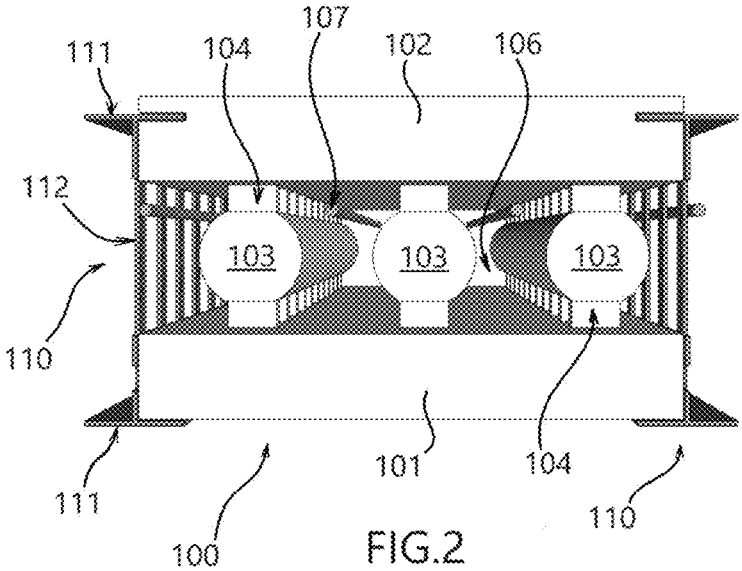
FIG. 2 is a top perspective view showing the Modular formwork unit shown in FIG. 1, incorporating a furring strip assembly on both sides of the Modular formwork unit, according to the present disclosure.
Figure 4:
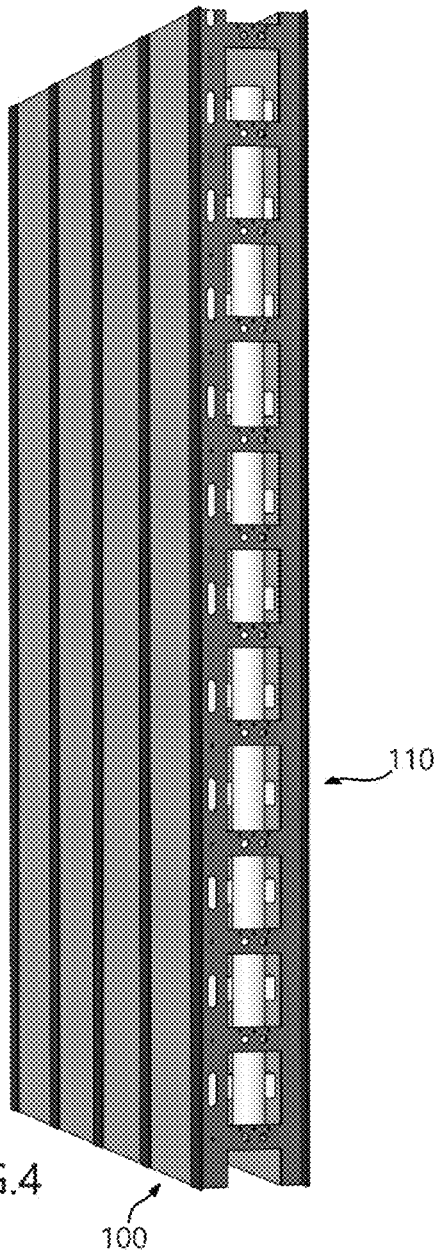
FIG. 4 is a perspective view of vertically oriented Modular formwork units of the Modular formwork unit shown in FIG. 1, where the Modular formwork units are joined together by the furring strip assemblies held in between, to form an insulated hollow core wall structure, according to the present disclosure.
Figure 5:
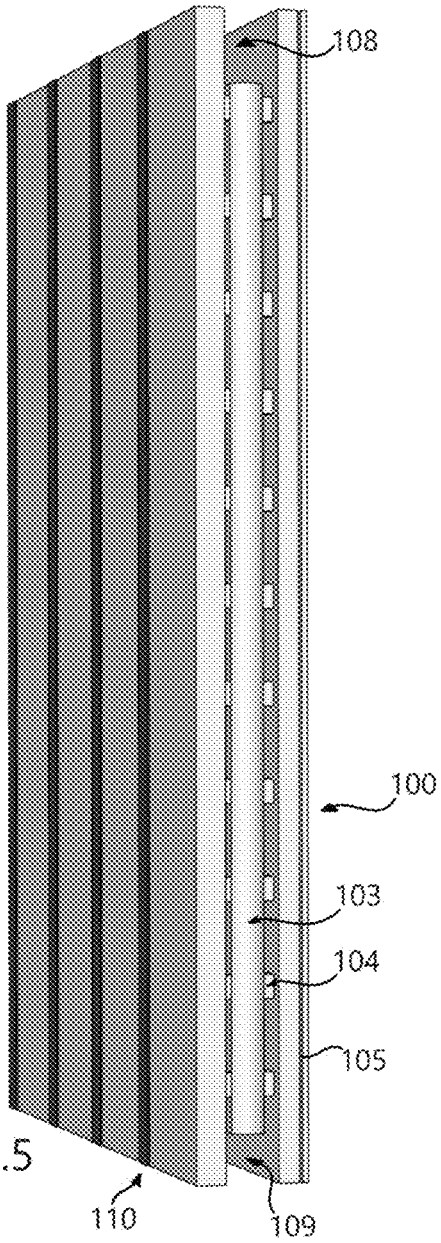
FIG. 5 is a perspective view of vertically oriented Modular formwork units of the Modular formwork unit shown in FIG. 1, indicating locations of a cavity that forms top and bottom edge beams, according to the present disclosure.
Figure 6:
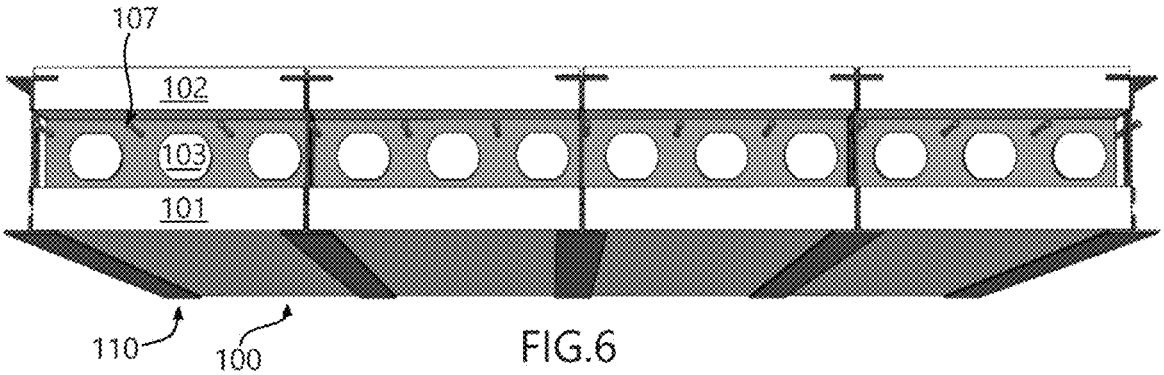
FIG. 6 is a top perspective view of the joined Modular formwork units shown in FIG. 4, showing reinforcing rebars for the wall structure, and partial filling of concrete.
Figure 7:
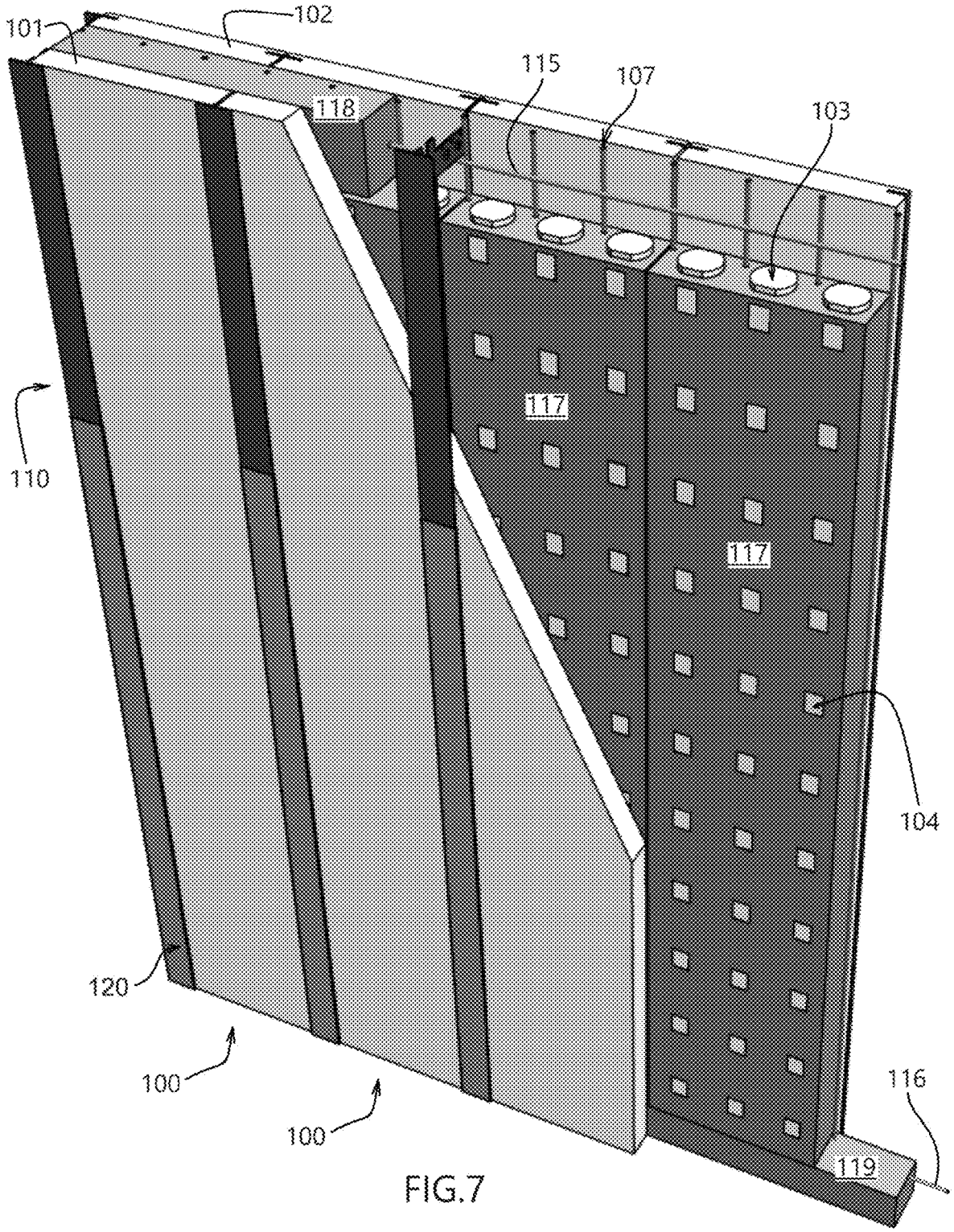
FIG. 7 is a perspective view illustrating parts and layers of a casted insulated hollow core wall structure, with top and bottom edge beams using the Modular formwork unit and the furring strip assembly depicted in FIGS. 1,2,3,4,5, and 6. Also having a metal casing C-channel incorporated with the furring strip assembly flanges as detailed in FIGS. 12 and 13, according to the present disclosure.

Referring to the drawings and according to the present disclosure of Insulated hollow core concrete form system, implementations may include one or more of the following features: In FIGS. 1,2,3,4,5,6, and 7, a Modular formwork unit 100, with a pre-determined dimension is formed, to construct an insulated hollow core wall structure. And a furring strip assembly 110 is used to join the units together of the Modular formwork unit 100 until the chosen wall width is reached. In FIGS. 1,2,4,5,6, and 7, the Modular formwork unit 100 has longitudinal void formers 103 that are integrated in between two spaced parallel side panels, an interior side panel 101, and exterior side panel 102, to define a forming cavity 106 of a hollow core section. This forming cavity 106 is disposed to receive concrete or other hardening material to form a hollow core wall structure 117 shown in FIG. 7. The longitudinal void formers 103 are joined in between the two spaced parallel side panels, the interior side panel 101 and the exterior side panel 102 by nodal junctions 104, shown in FIGS. 1,2,5 and 7. The longitudinal void formers 103 are truncated of upper and lower extents of the Modular formwork unit 100 as shown in FIG. 5. This truncation defines a top edge cavity 108 that forms a top edge beam 118 which is reinforced by rebars 115 and located at the top of the insulated hollow core wall structure, and a bottom edge cavity 109 that forms a bottom edge beam 119 reinforced by rebars 116 and located at the bottom of the insulated hollow core wall structure as shown in FIG. 7. In FIG. 2 the furring strip assembly 110 may have an I-shaped cross section defined by two retaining flanges 111, and a connecting web 112 spanning between the retaining flanges 111. In FIG. 3 side elevation of the connecting web 112 is shown, where it may have an electrical wiring cutout 113, to allow electrical wires to extend behind the retaining flanges 111 without the need for cutting those retaining flanges 111, and may also include one or more of a rebar tying eyelet 114 to tie a rebar 107 to the connecting web using a wire or a zip tie. The retaining flanges 111 of the furring strip assembly 110 can be exposed on the exterior side panel 102, where exterior siding materials can be attached, and also can be exposed on the interior side panel 101, where interior finishing materials can be attached. Additionally, the retaining flanges 111 have a thickness that projects attached siding materials a distance from the Modular formwork unit 100 surface. This projection can provide a drainage plane which can drain any water that may seep behind the siding material. Alternatively, for an outer surface of the Modular formwork unit 100 to be ready for stucco finishing application or similar, the exterior flange of the retaining flanges 111 of the furring strip assembly 110 can be received in a groove cut 105 within the exterior side panel 102 as shown in FIGS. 1,2, and.5.

Figure 8:
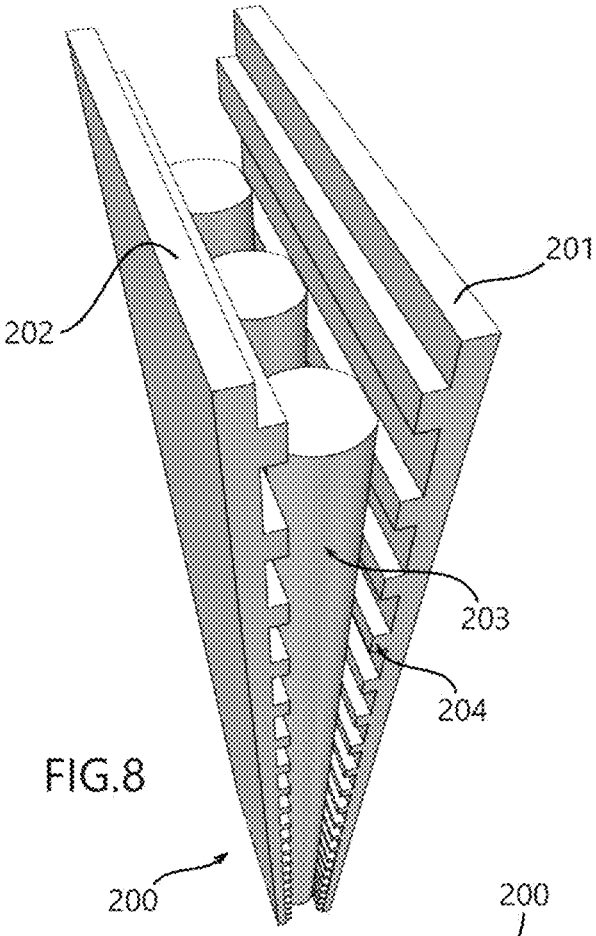
FIG. 8 is a perspective view of a Modular formwork unit formed for insulated hollow core wall construction, where the interior surface of the two side panels of the Modular formwork unit has a corrugated pattern, according to the present disclosure.
Figure 9:
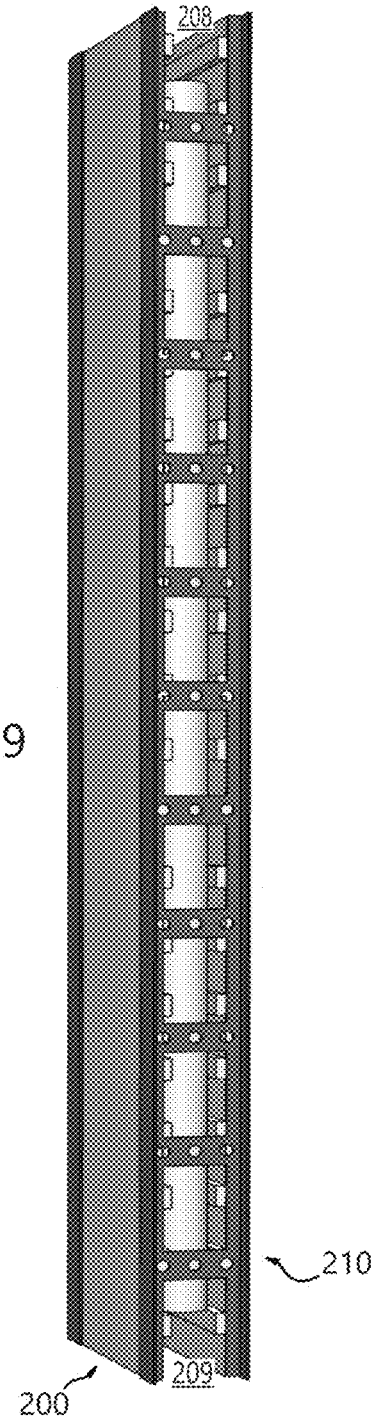
FIG. 9 is a side perspective view of the Modular formwork unit shown in FIG. 8, incorporating a furring strip assembly attached on both sides of the Modular formwork unit and indicating locations of a cavity that forms top and bottom edge beams, according to the present disclosure.
Figure 10:
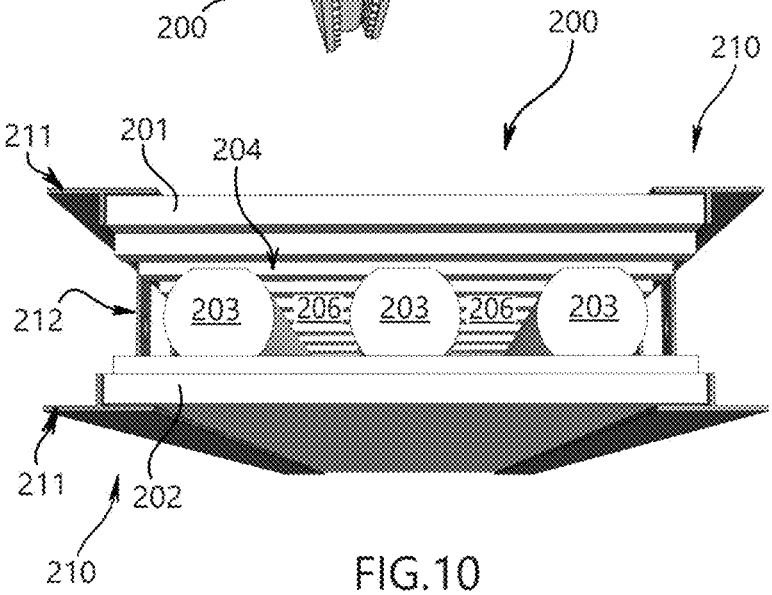
FIG. 10 is a top perspective view of the Modular formwork unit and the attached furring strip assemblies shown in FIG. 9.
Figure 11:
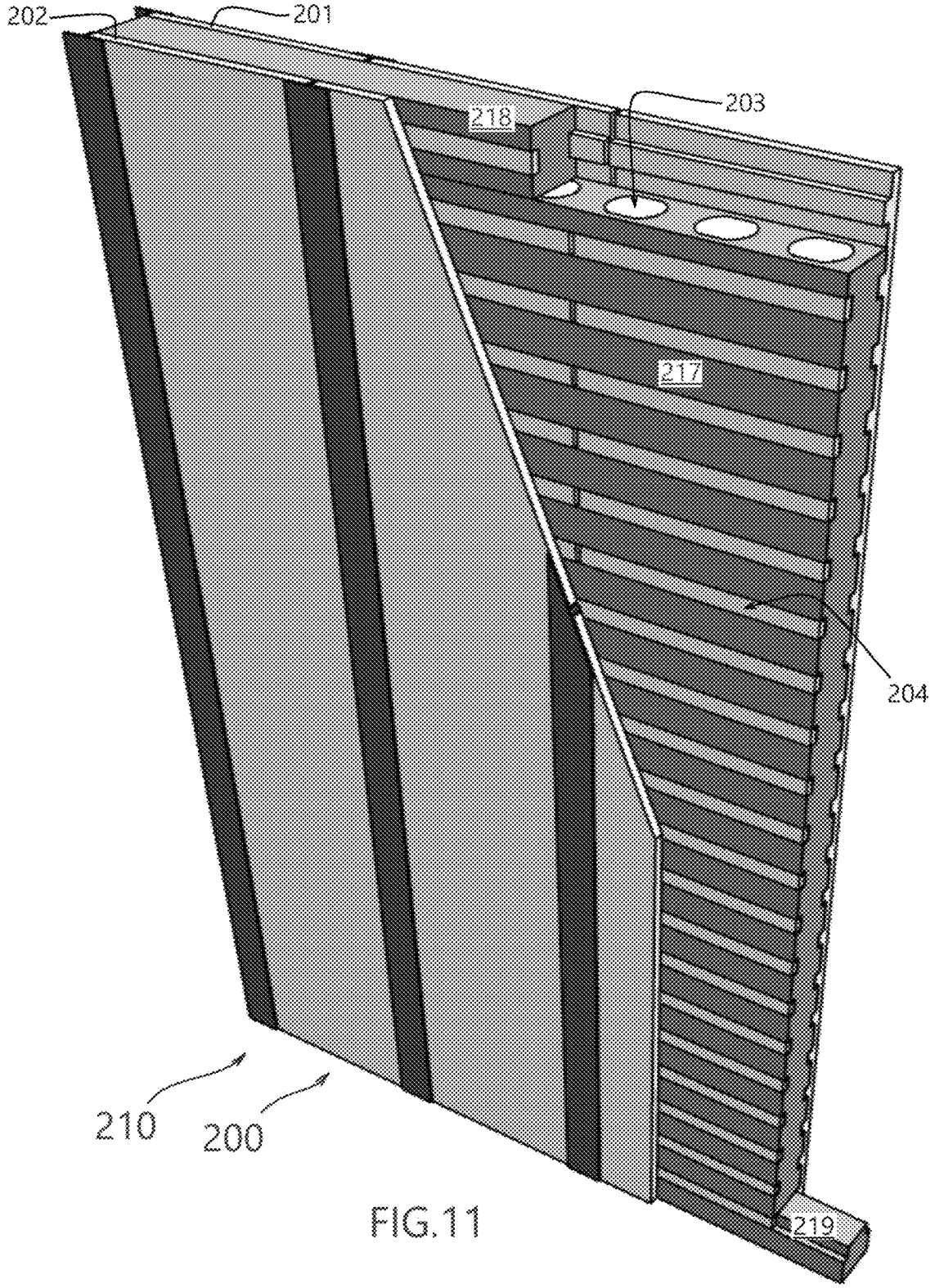
FIG. 11 is a perspective view illustrating parts and layers of a casted insulated hollow core wall structure using the Modular formwork unit and the furring strip assembly depicted in FIGS. 8,9, and 10.
Figure 13:
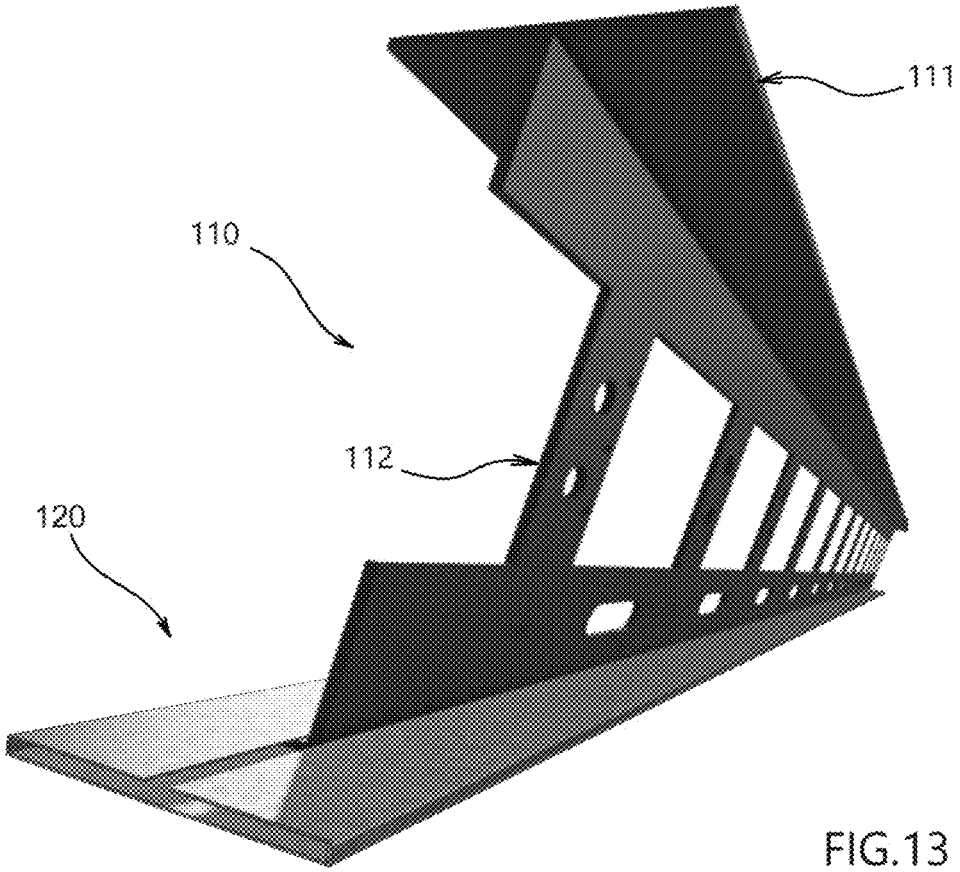
FIG. 13 is a perspective view of a furring strip assembly featuring one of its retaining flanges incorporating the metal casing C-channel shown in FIG. 12, according to the present disclosure.

The Insulated hollow core concrete form system, where in FIGS. 8,9,10, and 11 a Modular formwork unit 200, with a pre-determined dimension is formed to construct an insulated hollow core wall structure. And a furring strip assembly 210 is used to join the units together of the Modular formwork unit 200 until the chosen wall width is reached. The Modular formwork unit 200 has longitudinal void formers 203 that are integrated in between two spaced parallel side panels, where both first side panels 201 and second side panel 202 have a corrugated pattern to define a forming cavity 206 shown in FIG. 10. The forming cavity 206 is disposed to receive hardening material to form a hollow core wall structure 217 shown in FIG. 11. The longitudinal void formers 203 are seamlessly joined in between the two spaced parallel side panels at the intersecting points with the projecting ridges 204 of the corrugated pattern as shown in FIG. 9. The corrugated pattern design may enable a reduction in a Modular formwork unit sides thickness while preserving its rigidity. The longitudinal void formers 203 are truncated of upper and lower extents of the Modular formwork unit 200 as shown in FIGS. 8,9, and FIG. 11. This truncation defines a top edge cavity 208 that forms a top edge beam 218 located at the top of the insulated hollow core wall structure and a bottom edge cavity 209 that forms a bottom edge beam 219 located at the bottom of the insulated hollow core wall structure as shown in FIG. 11. In FIGS. 9,10, and 11, a furring strip assembly 210 may have an I-shaped cross section defined by two retaining flanges 211 and a connecting web 212 spanning between the retaining flanges 211.

Figure 14:
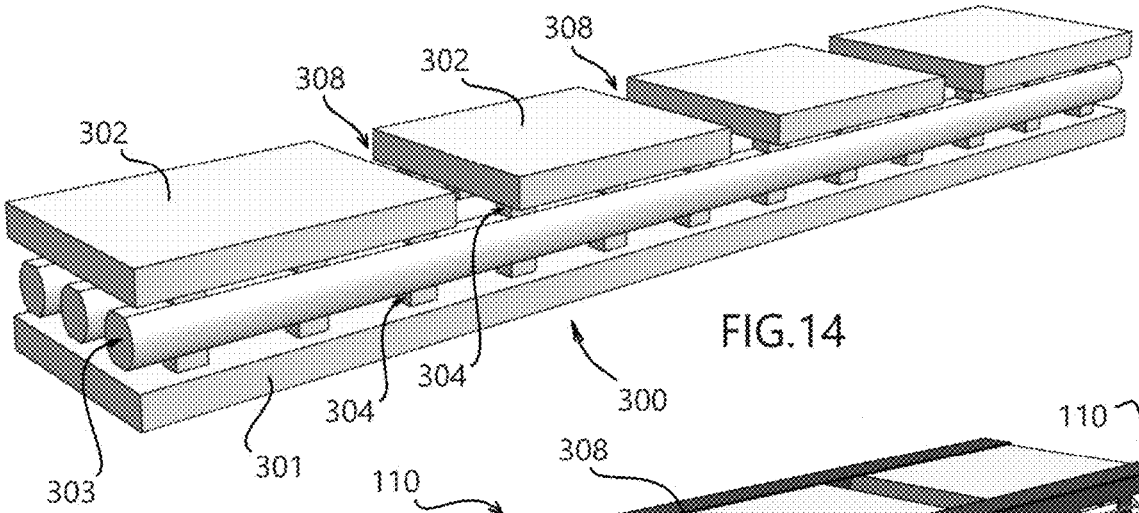
FIG. 14 is a top angular perspective view of a Modular formwork unit formed for insulated hollow core slab construction, according to the present disclosure.
Figure 15:
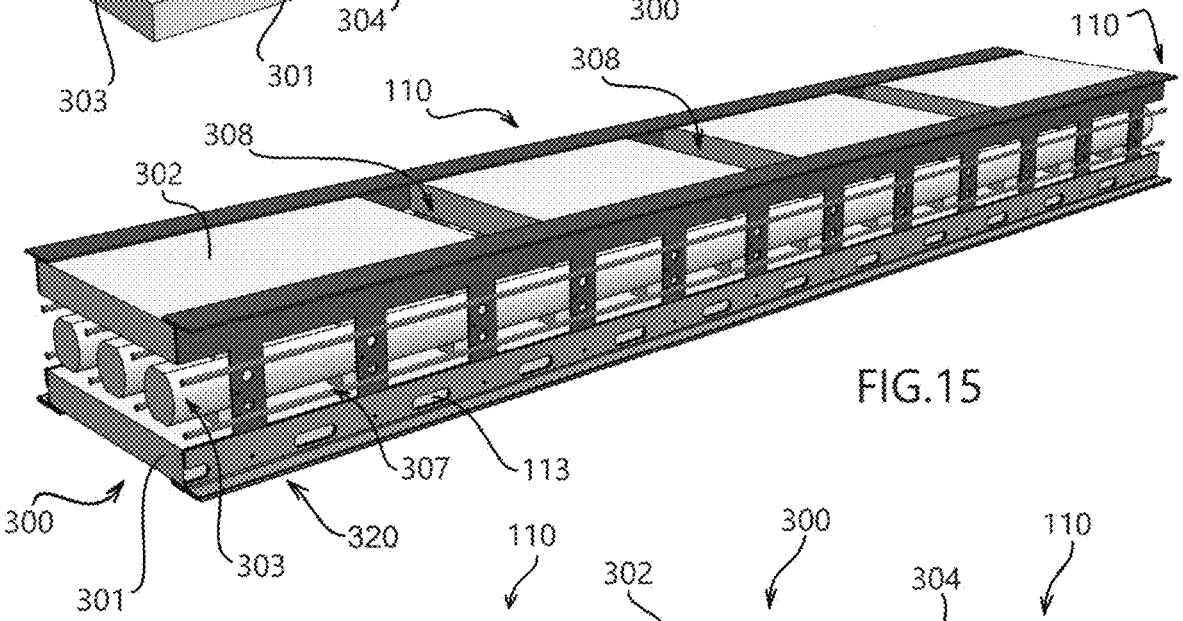
FIG. 15 is a top angular perspective view showing the Modular formwork unit shown in FIG. 14, having a furring strip assembly attached on both sides of the Modular formwork unit, reinforcing rebars, and a metal casing T-channel incorporated with the bottom retaining flange of the furring strip assemblies as detailed in FIGS. 17 and 18, according to the present disclosure.
Figure 16:
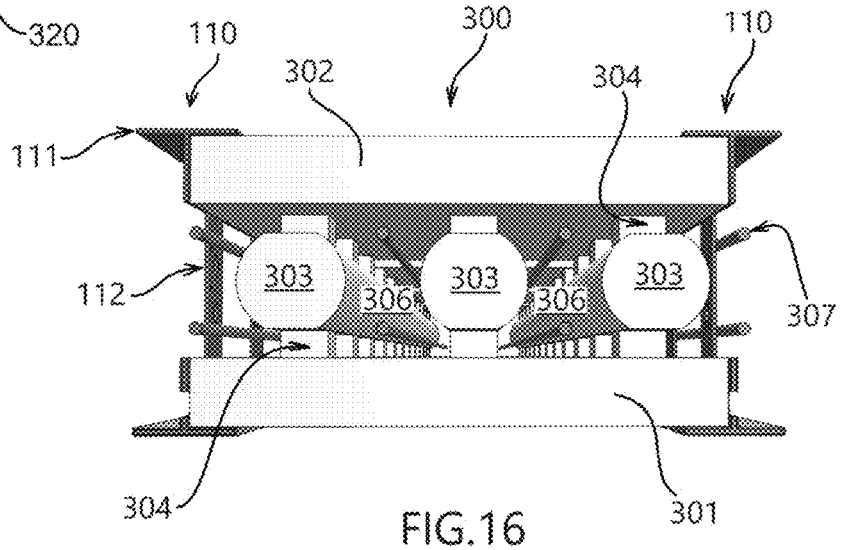
FIG. 16 is a front view of the Modular formwork unit shown in FIG. 15.
Figure 22:
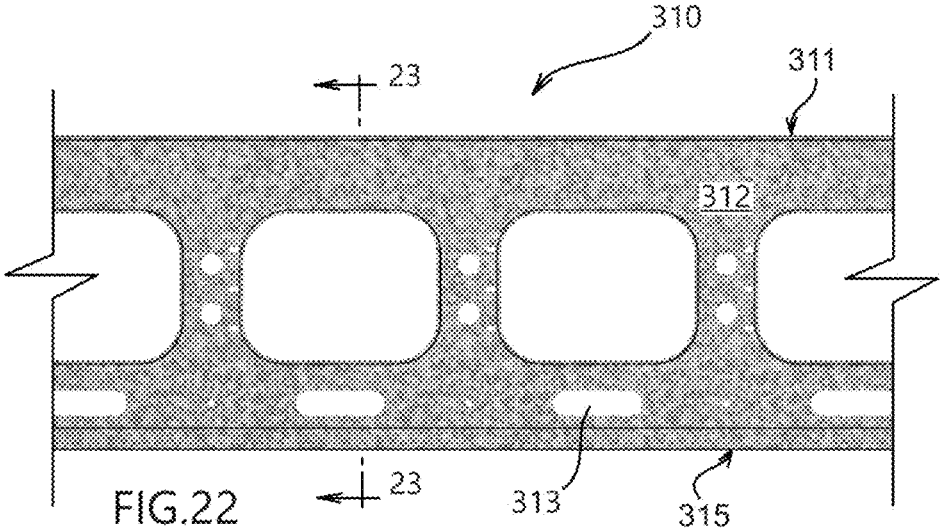
FIG. 22 is an enlarged side elevation view of a portion of the metal furring assembly presented in FIGS. 20 and 21, according to the present disclosure.
Figure 23:
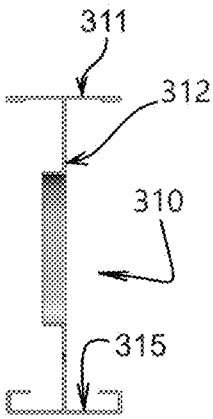
FIG. 23 shows a cross-section view of the metal furring assembly shown in FIG. 22, according to the present disclosure.

The Insulated hollow core concrete form system, where In FIGS. 14,15,16, and 19 a Modular formwork unit 300, with a pre-determined dimension is formed to construct an insulated hollow core slab structure. The furring strip assembly 110 is used to join the units together of the Modular formwork unit 300 until the chosen slab area is covered. The Modular formwork unit 300 has longitudinal void formers 303 that are integrated in between two spaced parallel side panels, bottom side panel 301, and upper side panel 302, to define a forming cavity 306 of a hollow core section. This forming cavity 306 is disposed to receive hardening material to form a hollow core slab structure 317 shown in FIG. 19. The longitudinal void formers 303 are joined in between the two spaced parallel side panels, the bottom side panel 301, and the upper side panel 302, by nodal connections 304 shown in FIGS. 14,16, and 19. The upper side panel 302 has cut apertures 308 to facilitate pouring of hardening material into the forming cavity 306, an example is shown in FIGS. 14 and 15. The forming system disclosed herein may also include a metal furring assembly 310 shown in FIGS. 20,21,22, and 23, where the metal furring assembly 310 is used to join the units together of the Modular formwork unit 300. This metal furring assembly 310 may increase the distance between shoring support during casting hollow core concrete slabs which can contribute to more savings in time and cost associated with erection and removal of these supports. In addition, the metal furring assembly 310 shape and thickness can be contingent upon its intended use and placement, In FIG. 23 the metal furring assembly 310 may have an I-shaped cross section defined by a top retaining flange 311, a the bottom retaining flange 315, and a connecting web 312 spanning between the retaining flanges. FIG. 22 shows the side elevation of the connecting web 312 where it may have an electrical wiring cutout 313 to allow electrical wires to extend behind the bottom retaining flange 315 without the need for cutting this retaining flange.

Figure 12:
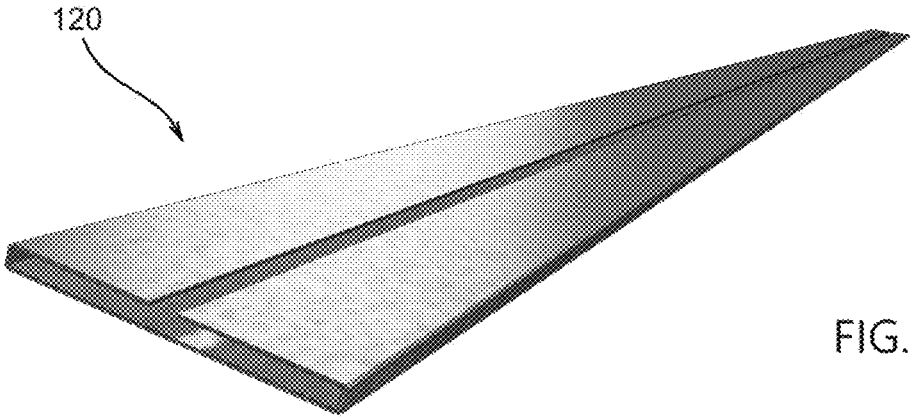
FIG. 12 is a perspective view of a metal casing C-channel, according to the present disclosure.
Figure 17:
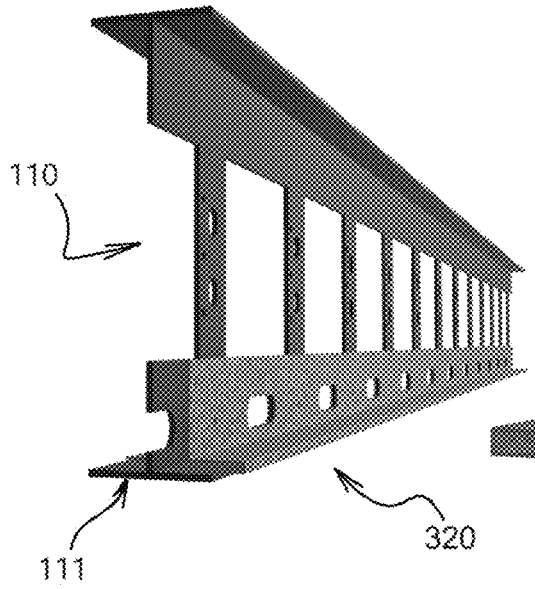
FIG. 17 is a perspective view of a furring strip assembly featuring one of its retaining flanges incorporating the metal casing T-channel enlarged in FIG. 18, according to the present disclosure.
Figure 18:
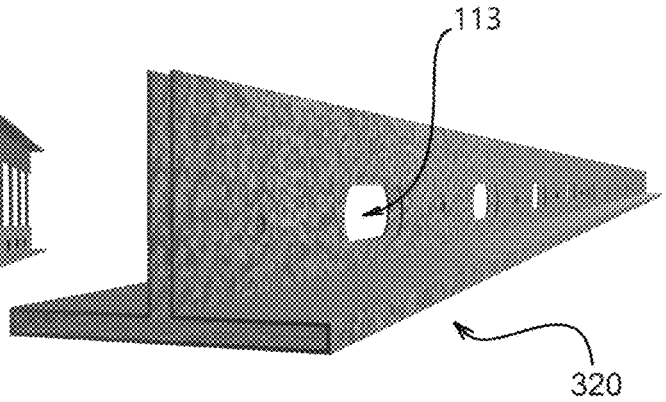
FIG. 18 is an enlarged perspective view of the metal casing T-channel depicted in FIG. 17.
Figure 19:
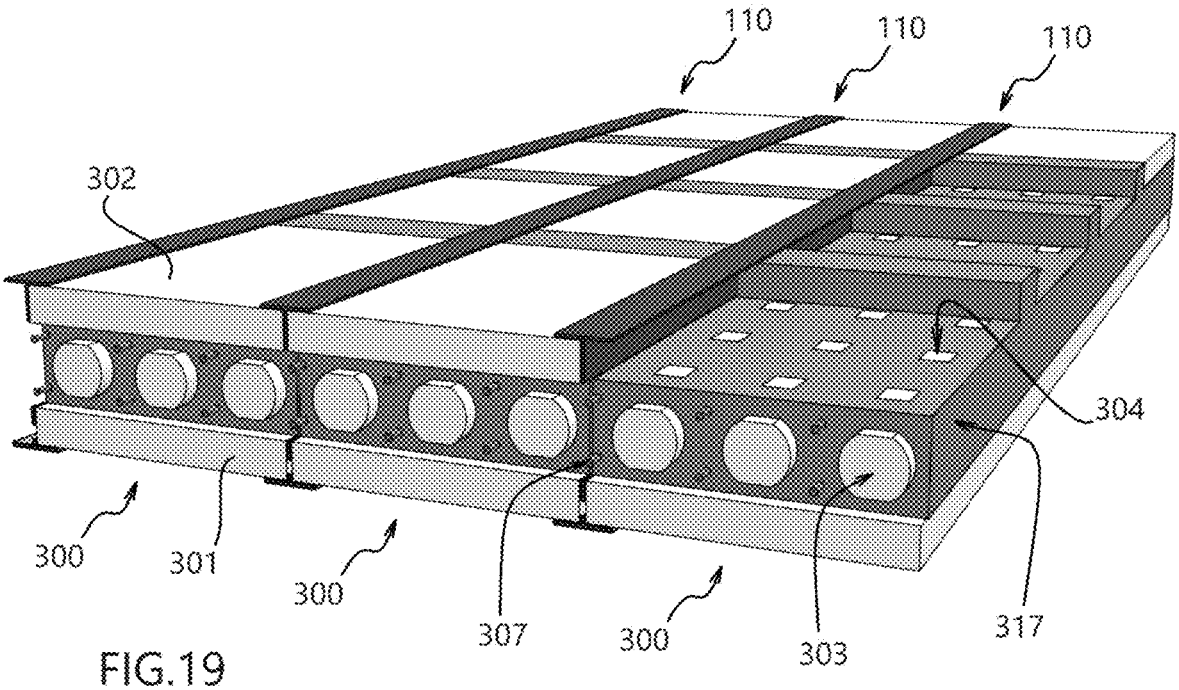
FIG. 19 is a top angular perspective view illustrating parts and layers of a casted insulated hollow core slab structure using the Modular formwork unit and the furring strip assembly presented in FIGS. 14,15, and 16.
Figure 20:
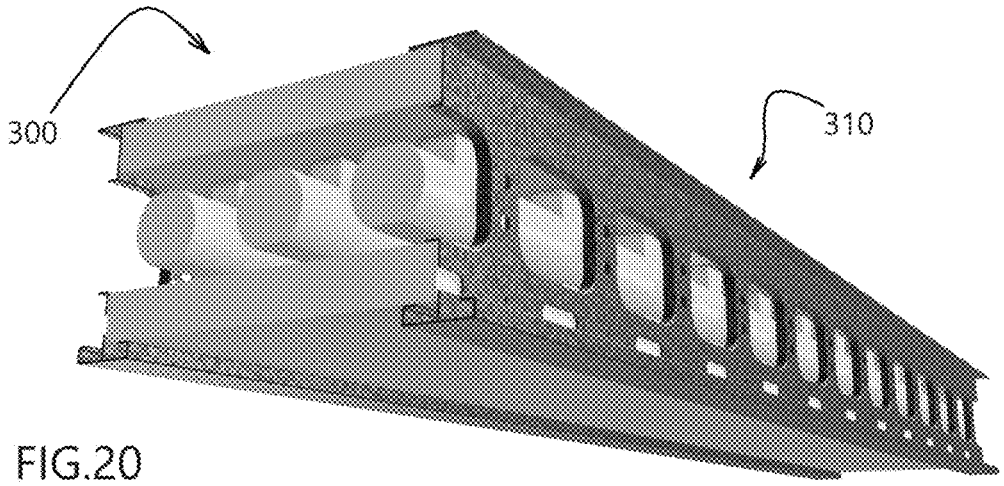
FIG. 20 is a right perspective view of the Modular formwork unit shown in FIG. 14 having a metal furring assembly attached on both sides of the Modular formwork unit, according to the present disclosure.
Figure 21:
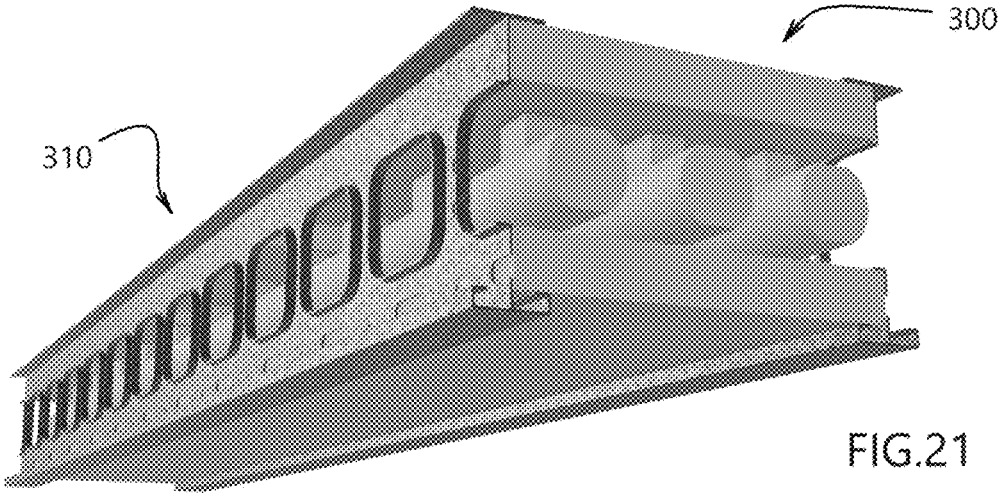
FIG. 21 is a left perspective view of the Modular formwork unit and the attached metal furring assemblies shown in FIG. 20.

The Insulated hollow core concrete forming system disclosed herein further include a metal casing C-channel 120 having a C-section profile that can allow one of the retaining flanges 111 of the furring strip assembly 110 to slide in the metal casing C-channel as illustrated by example in FIG. 12. The metal casing C-channel 120 can be used to reinforce the retaining flanges 111 of the furring strip assembly 110 and can provide a higher safety holding attached heavy claddings or finishing materials with greater pullout resistance. Also, the metal casing C-channel 120 can facilitate connectivity between furring strip assemblies and joining cut pieces, thus reducing waste. The Insulated hollow core concrete forming system disclosed herein yet further includes a metal casing T-channel 320 having a T-section profile, presented in FIG. 15, FIG. 17 and FIG. 18. This metal casing T-channel 320 can be used to reinforce the retaining flanges 111 of the furring strip assembly 110 and may resist deflection. Additionally, the metal casing T-channel 320 side cutouts can match those of the furring strip assembly connecting web 112 cutouts, as shown in FIG. 17, where the metal casing T-channel 320 has side cutouts matching to the electrical wiring cutout 113.

Both the metal furring assembly 310 and the furring strip assembly 110 of this disclosure forming system have their connecting webs embedded inside the hardened concrete. Hence, loads of attached finishing materials are transferred to concrete and those furring assemblies are prevented from being pulled out by the weight of finishing materials attached.

In conclusion, the insulated hollow core concrete forming system disclosed herein utilizes the benefits of both hollow core concrete design and insulated concrete form (ICF) technology in the construction industry. This integration allows for the construction of insulated hollow core walls and slabs with reduced quantities of concrete or hardening materials, resulting in reducing risk of form failure, and pollution generated by concrete, thereby resulting in a higher quality of finished product at reduced cost and improved building energy efficiency. This insulated hollow core concrete forming system also provides a time-saving installation process for cast-in-place concrete formwork through being easier to install for both walls and slabs. Moreover, provides a forming system with a structure that securely holds attached finishing materials with greater pullout resistance.

While the disclosure is susceptible to various modifications and alternative constructions, certain illustrative embodiments are shown in the drawings and are described in the forgoing discussion in detail. It should be understood, however, there is no intention to limit the disclosure to the specific embodiments disclosed, but on the contrary, the intention is to cover all modifications, alternative constructions, combinations, and equivalents falling within the spirit and scope of the disclosure.

What is claimed is:

1. An insulated hollow core concrete forming system directed towards constructing an insulated hollow core concrete wall and slab structures, comprising: at least one modular formwork unit, wherein the modular formwork unit comprises: two spaced parallel side panels, a plurality of longitudinal void formers fixed in spatial relationship in between and spaced apart from the two spaced parallel side panels by a plurality of nodal junctions, said longitudinal void formers extend longitudinally and continuously through the modular formwork unit to define a forming cavity enclosed between the two spaced parallel side panels and around the longitudinal void formers; a pourable concrete disposed in the forming cavity, wherein, upon curing, the concrete: a) forms a hardened concrete encapsulating the longitudinal void formers; b) defines a plurality of hollow cores in a resulting insulated hollow core concrete wall and slab structures; and c) forms a substantially cylindrical geometrical shape of the longitudinal void formers; wherein the longitudinal void formers extend within the forming cavity parallel to other adjacent longitudinal void formers and parallel to the two spaced parallel side panels; and wherein upon joining the modular formwork unit to other corresponding longitudinally or laterally oriented joined modular formwork units, the longitudinal void formers align coaxially with corresponding longitudinal void formers in the joined modular formwork units, forming the hollow cores to run continuously through the full height or the full length of the resulting insulated hollow core concrete wall and slab structures.

2. The insulated hollow core concrete forming system of claim 1, wherein the nodal junctions extend transversely, webbing between the two spaced parallel side panels and spaced apart along the full length of each longitudinal void former to join the plurality of longitudinal void formers to the two spaced parallel side panels at a predetermined distance from the two spaced parallel side panels, permitting flow of concrete around each longitudinal void former during the pouring of the concrete.

3. The insulated hollow core concrete forming system of claim 1, wherein the longitudinal void formers and the two spaced parallel side panels are composed of rigid insulating material.

4. The insulated hollow core concrete forming system of claim 1, comprising: forming a cured hollow core concrete structure disposed between the two spaced parallel side panels, wherein the two spaced parallel side panels are bonded to opposite sides of the cured hollow core concrete structure; the longitudinal void formers encapsulated within the cured hollow core concrete structure, wherein said longitudinal void formers extend through the full height or the full length of the cured hollow core concrete structure, thereby creating the hollow cores of the cured hollow core concrete structure; and wherein the longitudinal void formers and the two spaced parallel side panels are composed of rigid insulating material.

5. A method of forming an insulated hollow core concrete forming system directed towards constructing an insulated hollow core concrete wall and slab structures, comprising: providing at least one modular formwork unit, wherein the modular formwork unit comprises: two spaced parallel side panels, a plurality of longitudinal void formers fixed in spatial relationship in between and spaced apart from the two spaced parallel side panels by a plurality of nodal junctions, said longitudinal void formers extend longitudinally and continuously through the modular formwork unit to define a forming cavity enclosed between the two spaced parallel side panels and around the longitudinal void formers; pouring concrete in the forming cavity, wherein upon curing, the concrete: a) forms a hardened concrete encapsulating the longitudinal void formers; b) defines a plurality of hollow cores in a resulting insulated hollow core concrete wall and slab structures; and c) forms a substantially cylindrical geometrical shape of the longitudinal void formers; wherein the longitudinal void formers extend within the forming cavity parallel to other adjacent longitudinal void formers and parallel to the two spaced parallel side panels; and wherein upon joining the modular formwork unit to other corresponding longitudinally or laterally oriented joined modular formwork units, the longitudinal void formers align coaxially with corresponding longitudinal void formers in the joined modular formwork units, forming the hollow cores to run continuously through the full height or the full length of the resulting insulated hollow core concrete wall and slab structures.

6. The method of forming an insulated hollow core concrete forming system of claim 5, wherein the nodal junctions extend transversely, webbing between the two spaced parallel side panels and spaced apart along the full length of each longitudinal void former to join the plurality of longitudinal void formers to the two spaced parallel side panels at a predetermined distance from the two spaced parallel side panels, permitting flow of concrete around each longitudinal void former during the pouring of the concrete.

* * * * *